United States Patent [19]

Cirrito

[11] 4,146,361

[45] Mar. 27, 1979

[54] APPARATUS FOR HOT GAS HEAT TRANSFER PARTICULARLY FOR PAPER DRYING

[76] Inventor: Anthony J. Cirrito, 41 Old Upton Rd., Grafton, Mass. 01519

[21] Appl. No.: 582,558

[22] Filed: May 30, 1975

Related U.S. Application Data

[60] Continuation of Ser. No. 286,927, Sep. 7, 1972, abandoned, which is a division of Ser. No. 129,165, Mar. 29, 1971, abandoned, which is a continuation of Ser. No. 705,778, Feb. 15, 1968, abandoned.

[51] Int. Cl.[2] ..... F27B 9/28

[52] U.S. Cl. ..... 432/60; 432/220; 60/39.07; 34/124; 34/155; 34/160

[58] Field of Search ..... 60/39.07, 39.17, 39.18 B, 60/39.5, 39.15, 39.21, 13 F; 34/119, 124, 155, 160; 432/59, 60, 220, 8, 11

[56] References Cited

U.S. PATENT DOCUMENTS

| | | | |
|---|---|---|---|
| 2,275,543 | 3/1942 | Meyer | 432/60 |
| 2,365,616 | 12/1944 | Zweifel | 60/42 |
| 2,409,159 | 10/1946 | Singleton | 432/220 |
| 2,482,819 | 9/1949 | Williams | 60/49 |
| 2,700,830 | 2/1955 | Wolfe | 34/65 |
| 2,760,410 | 8/1956 | Gillis | 34/160 |
| 2,763,477 | 9/1956 | Marks | 34/119 |
| 2,859,954 | 11/1958 | Grey | 423/220 |
| 2,933,425 | 4/1960 | Hess | 266/103 |
| 3,295,842 | 1/1967 | Stelling, Jr. et al. | 432/8 |
| 3,447,247 | 6/1969 | Daane | 34/122 |
| 3,874,091 | 4/1975 | Fukumoto | 432/59 |

FOREIGN PATENT DOCUMENTS

| | | | |
|---|---|---|---|
| 256701 | 8/1926 | United Kingdom | 34/124 |

*Primary Examiner*—John J. Camby
*Assistant Examiner*—Larry I. Schwartz
*Attorney, Agent, or Firm*—Raymond H. Synnestvedt

[57] ABSTRACT

Regenerative compression-combustion-expansion cycle engines are utilized to generate hot, high pressure gases for heat transfer use. The gas generation equipment includes temperature modulation by water injection, recycle of spent gas, and injection of turbine-expanded gas into the main hot gas stream. Separate combustion chambers are also utilized for exploiting low-cost fuel and increasing gas temperature. Special heat transfer equipment including helical nozzle arrays are provided for paper drying, the nozzle arrays being arranged to indirectly heat materials, such as paper, being dried, to radiantly heat such material, and to directly heat such material by impinging hot gas directly thereon. Continuously cleaned rotary filters, as well as jet operated doctor blades may be used in association with the nozzles. Hot high pressure gases are also employed for water removal from paper and similar materials by being forced through wet paper carried between two felts, and equipment leading the gas to and away from such a felt-paper sandwich is provided. One embodiment of such equipment includes an impervious gas conducting belt. The use of hot high pressure gases as a source of flow and turbulent energy for heat transfer purposes results in extremely efficient heat utilization, and the heat transfer equipment exploits to the fullest the properties of such hot pressure gases to minimize film resistance to heat transfer.

25 Claims, 30 Drawing Figures

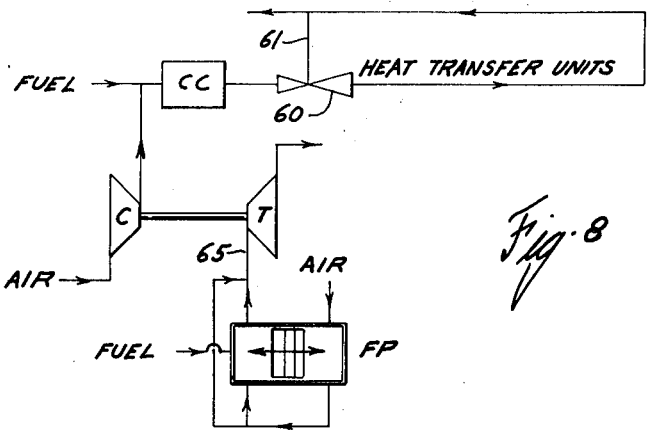
Fig. 8
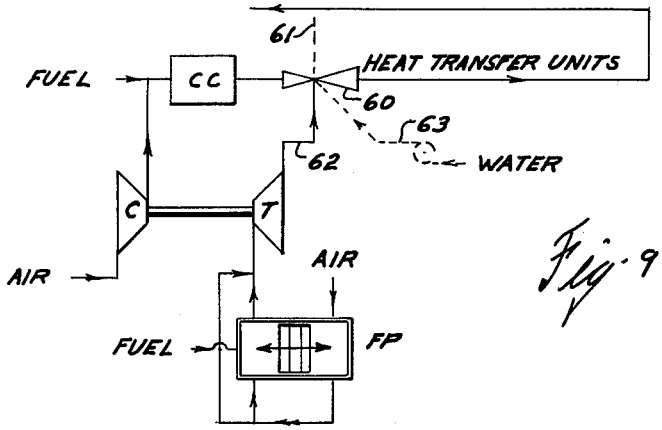
Fig. 9
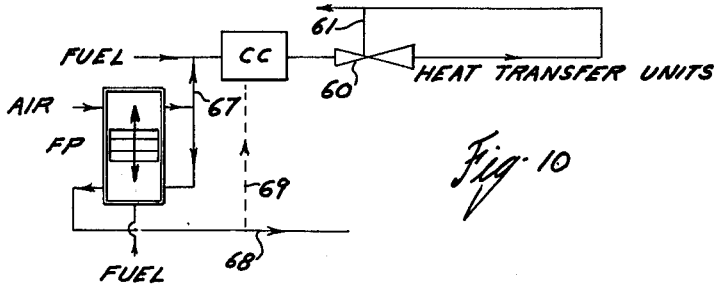
Fig. 10
Fig. 11
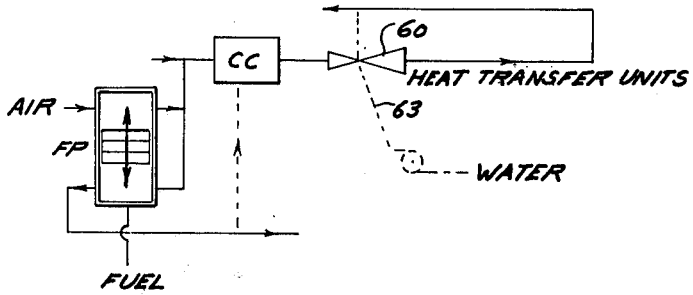

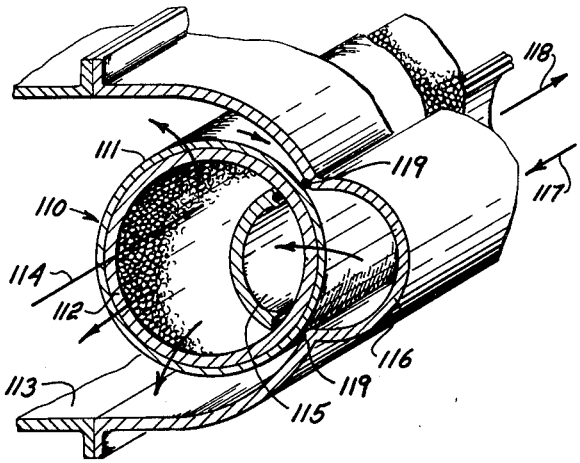
Fig-16
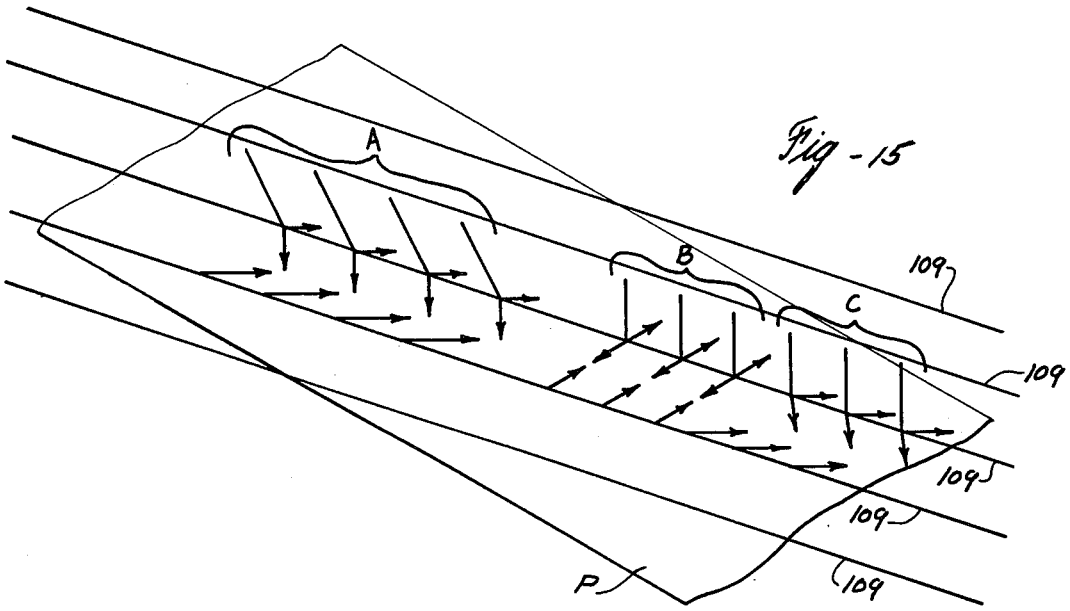
Fig-15
Fig-14
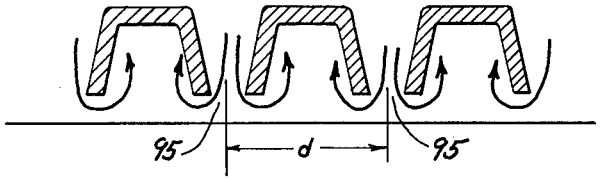

21
150
151
152
153
154
155
156
157
158
159
160
161
162
163
170
171
172
173
174
175
176
177
178
179
180
181
182
183

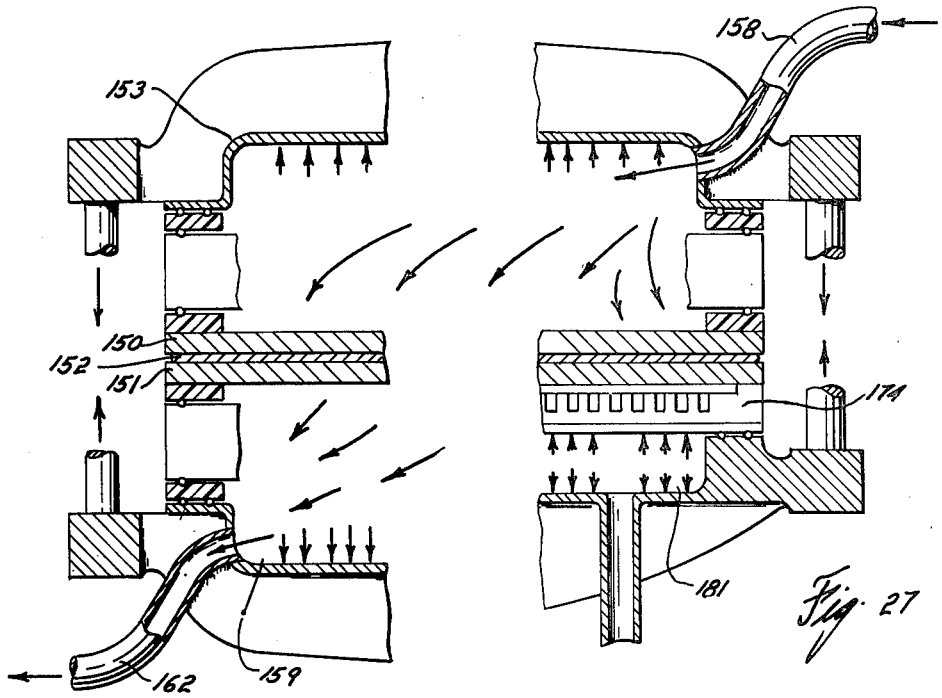
Fig. 27
Fig. 29
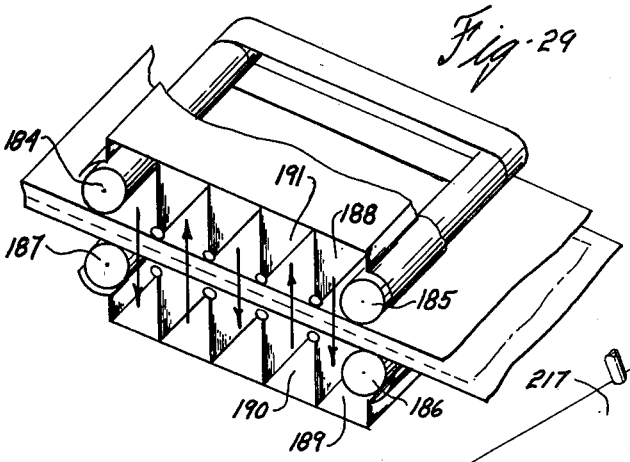
Fig. 28
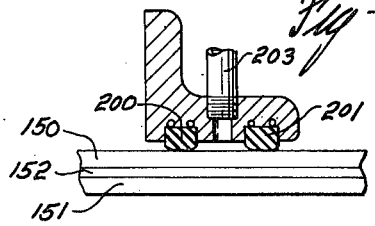
Fig. 30
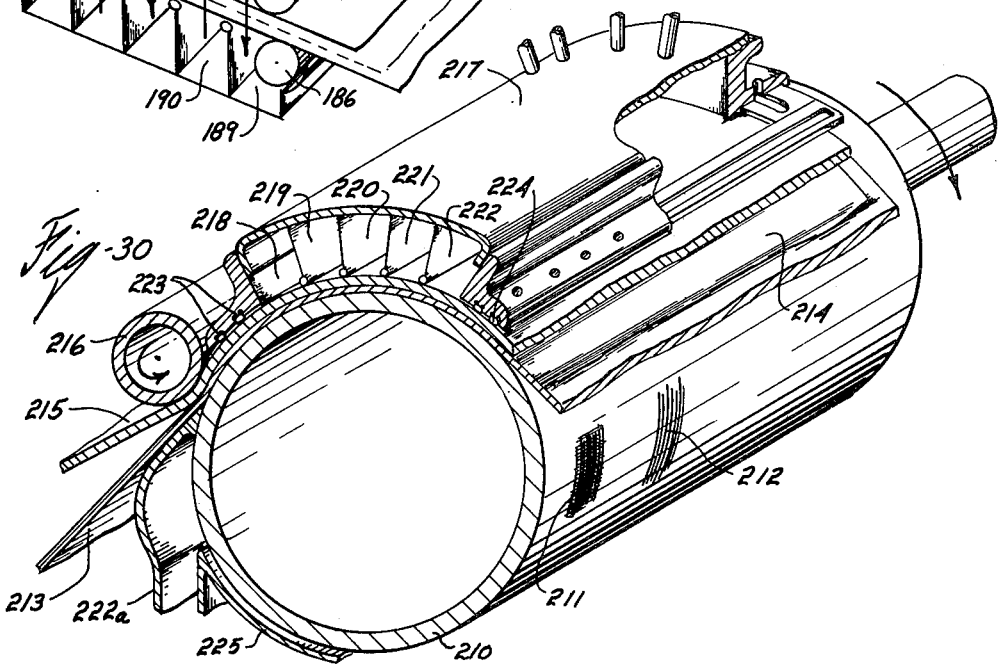

APPARATUS FOR HOT GAS HEAT TRANSFER PARTICULARLY FOR PAPER DRYING

This application is a continuation of my prior, copending application Ser. No. 286,927, filed Sept. 7, 1972 now abandoned, which was a division of my application Ser. No. 129,165, filed Mar. 29, 1971 now abandoned, which was a continuation of my application Ser. No. 705,778, filed Feb. 15, 1968 now abandoned, entitled "Method and Apparatus for Hot Gas Heat Transfer, Particularly for Paper Drying". The method subject matter of the invention was carried through said application Ser. No. 129,165 (along with the apparatus subject matter) and became the subject of my copending application Ser. No. 358,498, filed May 9, 1973.

This invention relates to the art of heat transfer and especially to that part of the heat transfer art in which hot gases are utilized as a heat transfer material. It is particularly concerned with drying operations by the use of hot gases such as the drying operations involved in the manufacture of paper or paperboard.

In one of its broader aspects the invention is concerned with the provision of equipment for generating hot gases in a form which is particularly suited for effective heat transfer use. Another aspect of the invention involves equipment for making the most effective use of such hot gases.

A number of the features of the present invention are of special advantage in the paper drying field. In order to produce paper at desirably high rates, it is necessary to have means for delivering large quantities of heat to the paper. As will be discussed further herein, the rate at which heat is transferred is dependent upon several factors, among them the coefficient of heat transfer, the temperature gradient, and the length of time during which the paper is exposed to the drying action of the hot gases.

In accordance with the invention steps are taken to maximize the heat transfer coefficient by generating the hot gases at high pressures, by utilizing the pressure of the hot gases to generate rapid turbulent flow of the gases past the heat transfer surface, and by utilizing especially constructed means for bringing the hot gases into turbulent contact with the heat transfer surface. The net effect of these steps is to reduce the film thickness in the gases at the heat transfer surface, which film is the primary resistor of heat flow across the surface.

In order to develop the rapid turbulent flow of the heat containing gases past the heat transfer surface, the invention contemplates the provision of a heat engine especially configured to generate hot gases at high pressure. The high pressure gases are expanded to convert a portion of the energy stored in them to kinetic energy of flow adjacent the heat transfer surfaces. The energy stored in the gas by reason of its pressurization is also used to transfer gas from the heat engine to and beyond the heat exchange surface.

The kinetic energy of flow in the gas moving through the conduits and past the heat transfer surface is dissipated by being converted into heat. But the heat so generated is utilizable for heat transfer purposes in the same manner as the heat initially stored in the gas. Thus it can be seen that, except for minor radiation losses, substantially the entire energy input at the heat engine is available for heat transfer. The theoretical limit for efficiency of heat transfer is thus 100%.

In the preferred embodiments, the heat engines are so arranged internally, and in their cooperation with the remainder of the heat transfer system, that substantially no shaft work is performed by the heat engine on the surroundings. Internally, however, a portion of the energy of combustion resulting from the burning of fuel in the engine is utilized to operate gas compressor means. The gas so compressed is raised in temperature by being mixed with fuel, and the resulting mixture is combusted in a combustion chamber to provide the high pressure heat transfer gases.

In the preferred embodiments the heat engine is of the regenerative compression-combustion-expansion cycle type as typified by gas turbines and free piston engines. In addition, high temperature gas eductors or ejectors are advantageously utilized as components of the heat engine. They are especially useful in connection with certain features of the invention to be discussed more fully below, namely, the provision of re-cycle of a portion of the heat transfer gases and the provision of modulating material in the heat transfer gases. Various combinations of compressor means, compressor drive means, combustion chamber means and ejector means can be provided to form the heat engine generators of hot high pressure heat transfer gases in accordance with the invention.

It is an object of this invention to provide methods and apparatus for generating hot high pressure gases for heat transfer use.

Another object of the invention is the provision of generating means and methods for creating hot high pressure gases through a compression-combustion-expansion-type cycle, in a manner to recover substantially all the energy put into such means, through the fuel, for heat transfer purposes.

Another object of the invention is to provide heat transfer equipment, especially drying equipment, adapted to fully exploit heat transfer properties of hot high pressure gases.

Still another object of the invention is the provision of improved plenum and nozzle systems for use in heat transfer, especially for paper drying.

Another object of the invention is the provision of hot high pressure gas heat transfer devices arranged to utilize a gas in a series of stages.

A further object of the invention is the provision of improved filter mechanisms for cleaning hot high pressure gases in connection with their use as heat transfer materials.

An additional object of the invention is the provision of methods and equipment for utilizing hot high pressure gases to effect heat and mass transfer to dry paper by passing such gases through a web of wet paper.

Other objects of the present invention, together with the above objects, may be more readily understood by considering the detailed description which follows, together with the accompanying drawings in which:

FIGS. 2 through 11 are diagrammatic illustrations of other embodiments of the invention utilizing heat engines for generation of hot high pressure heat transfer gases;

FIG. 14 is a cross sectional view, on an enlarged scale, of nozzles employed in the unit of FIGS. 12 and 13;

FIG. 15 is a perspective diagram illustrating certain gas flow characteristics of gases being utilized in the unit of FIGS. 12 and 13;

FIG. 16 is a somewhat diagrammatic perspective view of a gas filter unit constructed in accordance with the invention with some parts being broken away;

FIG. 27 is a fragmentary cross sectional elevational view of the apparatus of FIG. 22, with parts omitted for the sake of simplicity;

FIG. 28 is a fragmentary cross sectional elevational view of a special seal utilized in the apparatus of FIG. 27;

FIG. 29 is a diagrammatic perspective view, with parts broken away, of another embodiment of equipment designed to utilize such hot high pressure gases by passing such gases through the paper.

FIG. 30 is a somewhat diagrammatic perspective view of another embodiment of the invention adapted to remove water from very wet paper.

PRODUCTION OF HOT HIGH PRESSURE GASES FOR HEAT TRANSFER USE

As mentioned above, in accordance with the invention, high temperature, high pressure, gases are created in a regenerative compression-combustion-expansion cycle for heat transfer. The use of the hot high pressure gases will be discussed later herein, but at this point attention is concentrated on means and techniques for creating them. In this connection, attention is directed to FIGS. 1 through 11, which illustrate the various arrangements of regenerative compression-combustion-expansion cycle equipment for these purposes. Throughout this series of figures, the turbine compressor portion of a gas turbine is indicated by the letter C, while the driving turbine is indicated by the letter T. In those instances where free piston devices are shown, they are marked with the letters FP. Combustion chambers in which fuel is mixed with compressed air and burned are marked with the letters CC. Directions of flow are indicated by arrows and various legends appear on the figures to aid in clarity of presentation.

Figure 1:
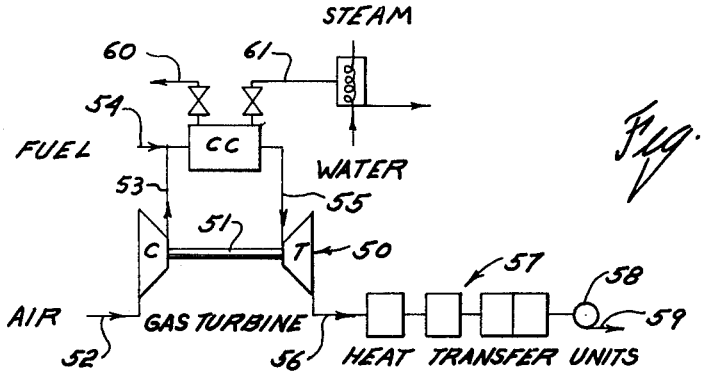
FIG. 1 is a diagrammatic illustration of regenerative compression-combustion-expansion cycle equipment for generating hot high pressure heat transfer gases.

Turning now to FIG. 1, there is shown a system employing a gas turbine 50 having a compressor C, and a driving turbine T connected to compressor C by shaft 51. Air is drawn into compressor C through line 52, where it is compressed as the rotor of compressor turns. The compressed air is delivered through line 53 to combustion chamber CC. Fuel is injected into the compressed air through line 54 as it is fed into the combustion chamber. The mixture of fuel and compressed air undergoes combustion in the combustion chamber, producing pressurized, high temperature gases. The main stream of such gases leaves the combustion chamber CC through line 55 which delivers it to the blades of turbine T of the gas turbine. In the preferred arrangement, the only load on the gas turbine is that of its compressor, and therefore the only depletion of the energy in the high temperature gases, aside from minor friction losses, is that use for compressing or entering the system. If desired, a minor shaft load may be placed on the turbine, although this will result in some reduction in overall efficiency of the system as a means for heat transfer.

Because the only work extracted from the high pressure gases passing through turbine T is that utilized for air compression, the exhaust gases flowing from the turbine through line 56 are still quite hot and are still at high pressure. These are utilized in heat transfer units diagrammatically indicated as a series of blocks 57. In the embodiment of FIG. 1, the gases are expanded during the course of heat transfer to less than atmospheric pressure; hence, they are restored to atmospheric pressure by fan 58 before being exhausted through line 59. If desired, a portion of the hot high pressure gases from the combustion chamber CC can be drawn off through line 60 for direct use as heat transfer fluid without having been passed through turbine T. Similarly, if desired, a portion of the combustion products can be drawn off through line 61 for use in an auxiliary steam generator or for other auxiliary purposes.

In a system such as that shown in FIG. 1, the presence of turbine T between the combustion chamber CC, and the point of use of the hot high pressure gases for heat transfer (57), presents two limitations which can be accepted for some purposes. However, in accordance with the invention, means are provided for overcoming or avoiding both of these limitations, and these means are shown in FIGS. 2 through 11. The first limitation is that the materials of construction of the turbine T can withstand only a certain temperature, the precise value depending on the particular material used to construct the turbine. The second limitation is that comparatively clean, and hence, comparatively expensive, fuel must be burned to form the gases passing through the turbine. If low cost fuel, such as bunker C oil, is used, the combustion products tend to be less clean and hence are corrosive to the turbine, thus shortening its life.

Figure 2:
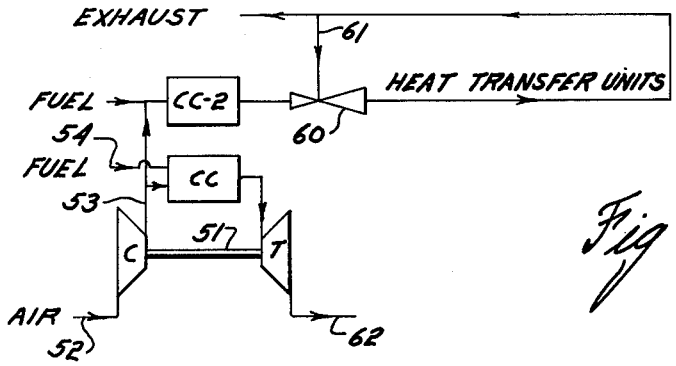

One step contemplated in accordance with the invention for overcoming the above limitations is the provision of a second combustion chamber in addition to the combustion chamber supplying gases to the turbine T. As will be explained below, the gases from the second combustion chamber are not passed through the turbine T, but are rather used direct for heat exchange purposes. Fuel which is cheaper and which produces "quasi clean" combustion products or products which would otherwise corrode turbine blades can be supplied to such a chamber. In addition, the operating conditions in such a chamber may be such that the temperature of the gases produced therein exceeds the temperature limitation of the turbine T. Such an arrangement is shown in FIG. 2, which illustrates a device similar in most respects to FIG. 1 except for the provision of a second combustion chamber CC-2 having a fuel supply separate from that for the first combustion chamber CC. The extremely hot gases from combustion chamber CC-2 are not passed through turbine T, but are fed directly to the heat transfer units. Compressed air is provided by compressor C both for combustion chamber CC which feeds hot gases to turbine T and to combustion chamber CC-2 which feeds very hot high pressure gases to the heat transferring units.

In connection with FIG. 2, it should also be pointed out that in accordance with another aspect of the invention, a portion of the gases which are passed through the heat transfer units can be recycled and mixed with fresh incoming gas originating in combustion chamber CC-2. For this purpose an ejector mixer 60 is provided to draw spent gases through recycle line 61 into the feed stream to the heat transfer units.

Figure 3:
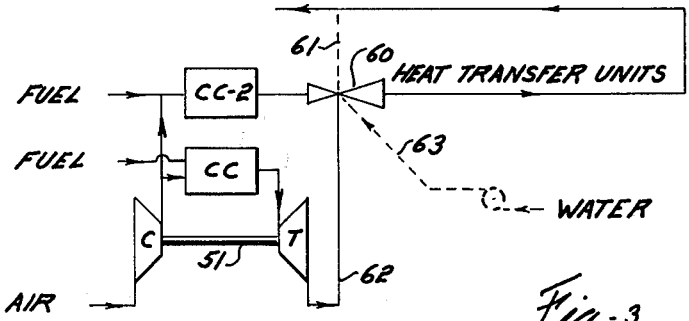

In the unit of FIG. 2 the gases passing through turbine T and issuing from that turbine through line 62 are exhausted. They can, of course, be passed through a series of heat transfer units such as those shown in FIG. 1. However, in accordance with an important feature of this invention, it is preferred to mix the gases issuing from turbine T with the hotter gases issuing from combustion chamber CC-2, and to transfer this mixture to the heat transfer units. This feature is shown in FIG. 3 where it can be seen that gases issuing from turbine T through line 62 are blended with hot gases from combustion chamber CC-2 in ejector 60. In FIG. 3 recycle line 61 is shown as a dashed line, since it may be omitted. The arrangement of FIG. 3 is especially advantageous because in addition to fully exploiting the heat content in the gases issuing from turbine T for heat transfer purposes, these gases are also used to modulate, to the extent desired, the temperature of the hot gases issuing from combustion chamber CC-2. Such modulation may be desired to lower the temperature of the gases fed to the heat transfer units to a suitable level.

FIG. 3 also illustrates a further feature of the invention. This is the provision of water injection means 63, through which water is fed into ejector 60. Addition of water to the gas stream passing through the ejector 60 permits further modulation of the temperature, if this is desired, without any substantial degradation of the desirable high pressure of the gases. Water injection also increases the mass flow of the gases fed to the heat transfer unit. The water added at ejector 60 is, of course, converted into superheated steam and the heat consumed in this conversion is not lost, but is available for recovery in the heat transfer units.

In summary, the units shown in FIGS. 2 and 3 for generating hot high pressure gases for the heat transfer units make use of a separate combustion chamber for generating gases hotter than can be tolerated by the turbine T, and these gases can be modulated in temperature by recycle, by water injection, and by mixing with the turbine exhaust gases. "Quasi clean" burning fuel can be used in the second combustion chamber, while a clean burning fuel is used in the first combustion chamber supplying gases to the turbine.

Figure 4:
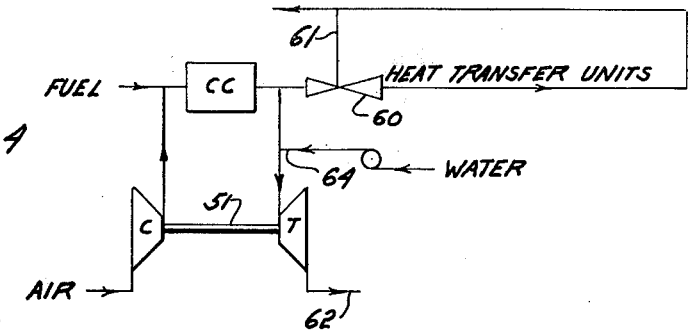

The unit shown in FIG. 4 makes use of only a single combustion chamber, and in this respect is like the unit of FIG. 1. However, the combustion chamber CC of FIG. 4 is designed to produce gases hotter than can be tolerated by turbine T. The bulk of these gases are fed through ejector 60 where they are mixed with recycle gas from line 61 if desired, and are fed to the heat transfer units. A portion of the very hot high pressure gases from combustion chamber CC are fed to turbine T, but are modulated in temperature by the injection of water through line 64. In the unit of FIG. 4, therefore, the turbine imposes no substantial temperature limitation on the gases issuing from combustion chamber CC, although these gases must still be relatively clean.

Figure 5:
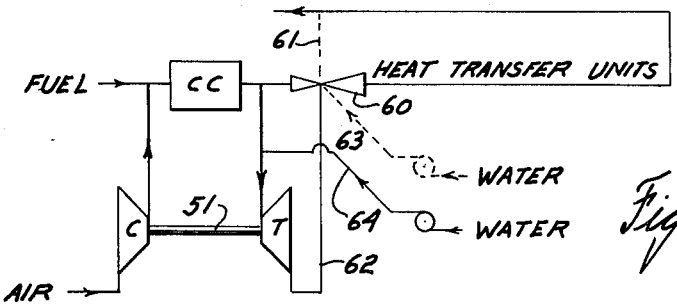

FIG. 5 illustrates a unit similar to FIG. 4, which has been modified in several respects. Again it is a single combustion chamber type device using water injection modulation of the gases fed to turbine T through the combustion chamber. In addition, the gases issuing from turbine T are mixed with the very hot high pressure gases from combustion chamber CC in ejector 60. As in FIG. 3, provision is made for injection of water through line 63 to ejector 60 for further temperature modulation and increase of mass flow.

Figure 6:
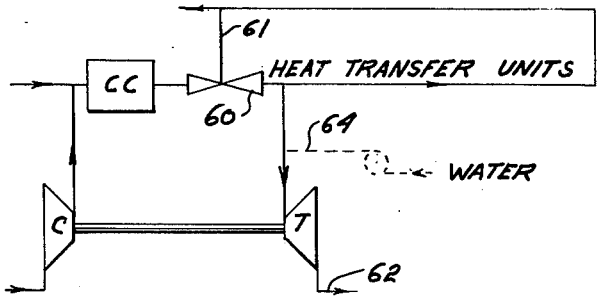
Figure 7:
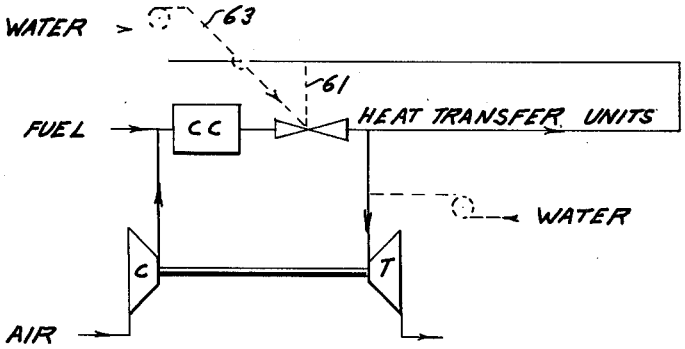

FIGS. 6 and 7 show additional single combustion chamber arrangements. Again, in each of these figures the combustion chamber CC is arranged to produce gases hotter than can be tolerated by turbine T. In FIG. 6, the gases to be fed to turbine T are taken from the downstream side of ejector 60 and therefore comprise a mixture of gases from combustion chamber CC and recycle gases from line 61. These gases are, of course, modulated in temperature by the recycle gases, and hence may be safely passed through turbine T. In addition, water may be injected through line 64 into the gases passing to turbine T to further lower their temperature. Once again, the turbine imposes no temperature limitation on the temperature produced by the combustion chamber CC but does impose a cleanliness limitation on it. The arrangement of FIG. 7 is much like that of FIG. 6 except that an additional water injection line 63 leads to ejector 60 for temperature modulation purposes to replace or supplement the temperature modulation accomplished by recycle gases in line 61.

The embodiments of FIGS. 8 through 11 share a common feature, that of a free piston device. Inasmuch as free piston cycles are well-known in the art, the free piston devices shown on these figures are shown only very diagrammatically. As is known, a free piston unit compresses air, mixes fuel with it, burns it, and exhausts hot high pressure gases. These gases may be mixed with additional fuel for further combustion. Furthermore, compressed air, as well as high pressure combustion gases may be taken as a product from the free piston unit.

In the unit of FIG. 8, there is provided, as in other units discussed above, a gas turbine having a compressor C and a turbine T. The compressed air produced in compressor C is mixed with fuel and combusted in combustion chamber CC, the hot high pressure gases issuing from compression chamber CC passing through the ejector to the transfer units. Recycle gas passing through line 61 is mixed with the gas from combustion chamber CC. In this respect, the unit of FIG. 8 operates much like the unit of FIG. 2 and the units of other figures. None of the gas from combustion chamber CC is used for driving turbine T. Gas for this purpose is produced in the free piston unit FP and a mixture of compressed air and exhaust combustion gases from this unit is fed through line 65 to the turbine. The gases issuing from the turbine through line 62 may be employed directly for heat transfer purposes or may be exhausted.

The unit of FIG. 9 is a modification of that shown in FIG. 8 and includes as additional features the mixing of the exhaust gases of turbine T passing through line 62 in ejector 60 with the hot high pressure gases from combustion chamber CC. In this figure, recycle mixing through line 61 is shown in dotted lines as an optional feature, as is water injection through line 63. The objects achieved by this arrangement are the same as discussed above, that is, the hot high pressure gases from combustion chamber CC are modulated to the extent desired by being mixed with turbine exhaust gases and, if desired, recycle gases and water.

In FIGS. 10 and 11 free piston units are shown which do not operate in conjunction with gas turbine units. In the installation of FIG. 10, compressed air from the free piston unit FP is delivered through line 67 to combustion chamber CC, where it is mixed with fuel and burned to produce hot high temperature gases which are then passed to the heat transfer units by means of ejector 60 which blends recycle gas from line 61 with the combustion gases. The combustion gases from free piston FP are delivered through line 68 for separate use. If desired, some of these gases may be delivered through line 69 to combustion chamber CC where they enter the stream of gases passing to the heat transfer units. FIG. 11 shows an installation much like that of FIG. 10 except that water injection means are provided for injecting water through line 63 to ejector 60 for temperature modulation purposes.

With the foregoing description of a number of devices for producing hot high pressure gases for heat transfer use in hand, some general comments concerning features of the present invention as they apply to such means can be made. First, the gases for heat transfer use are generated in regenerative compression-combustion-expansion cycles, and the fuel is commonly introduced into the cycle at the combustion stage after the combustion air has been compressed. Secondly, the cycles employed, whether they are performed in a gas turbine, a free piston device, or in a combination of both kinds of devices, result in the production of high pressure hot gases which are expandible, and are, in fact, at least in part expanded, either in a turbine device or in a free piston device, to provide the energy necessary to compress air entering the cycle. Thirdly, it should be noted that in the preferred arrangements, there is no shaft load on any of the devices by which the compression-combustion-expansion cycle is carried out, other than an internal load for operating the compression operation of the cycle. In other words, no net work is removed to the surroundings from the gas generation equipment in accordance with the preferred arrangement. Fourthly, if special steps are taken, at least part of the combustion portion of the cycle can be performed under conditions where the gases produced are both too hot and too dirty for use in driving mechanism, such as a turbine, for powering the compression stage of the cycle. These special steps include mixing of water into the gases to modulate the temperature, and provision of a separate combustion source for providing gases to drive the turbine or other device for compression power. These means may be used separately or in combination. Fifthly, the temperature of the compression gases can be modulated for heat transfer use in several ways. The preferred way is to mix them with gases which have been used in the expansion portion of the cycle, which maximizes the efficiency of the use of both streams of gases. In addition, and alternately, the gases may be modulated by being mixed with recycle gases or by having water injected into them. The last means also increases the mass flow of gases to the heat transfer units without substantial loss of pressure.

UTILIZATION OF HOT HIGH PRESSURE GASES FOR HEAT TRANSFER PURPOSES

The hot high pressure gases generated by the means and in the manner just described differ from more conventional heat transfer fluids, such as steam, or fan driven heated air, in several material respects. They are hot, having a temperature as high as about 900° to 1500° F., if they come directly from combustion chamber, or 600° to 1200° F., if they come from the turbine exhaust. Furthermore, the gases are at high pressure, and the energy represented by their high pressure is potentially available for creating turbulent flow and conversion into heat for heat transfer purposes. The gases, unlike steam (which can also be hot and at high pressure), are, in the main, made up of noncondensibles. Thus, they consist of nitrogen, unburned oxygen, carbon dioxide, and carbon monoxide as well as a certain amount of water vapor resulting from combustion of hydrogen in the fuel and/or the injection of water into the gases as outlined above. Despite a certain measure of water vapor in the gases, they differ radically from steam in that the fraction of condensibles is relatively low. This combination of properties in the hot high pressure gases generated in accordance with the invention gives them great potential for use as a heat transfluid, especially in drying operations of the kind necessary in the production of paper, kraftboard and the like.

However, in order to fully exploit the potential of the hot high pressure gases for heat transfer purposes, special steps and equipment arrangements are necessary. These will be discussed in this section, chiefly in the context of paper drying.

Because the operating conditions for various paper drying operations vary so widely, the application of the invention will be described with reference to several different characteristic types of paper drying operations and equipment. These different operations will also illustrate varsatility of the present invention in heat transfer systems having widely varying operating conditions.

YANKEE AND MG DRYERS

Yankee and MG Dryers are commonly used in the paper industry for forming light weight tissue-type paper. The water is removed from the paper in a single pass around a relatively large diameter drum. Such drying is characterized by high heat flows and relatively high temperature, although care must be taken to avoid excessive temperatures which will degrade the paper.

Figure 13:
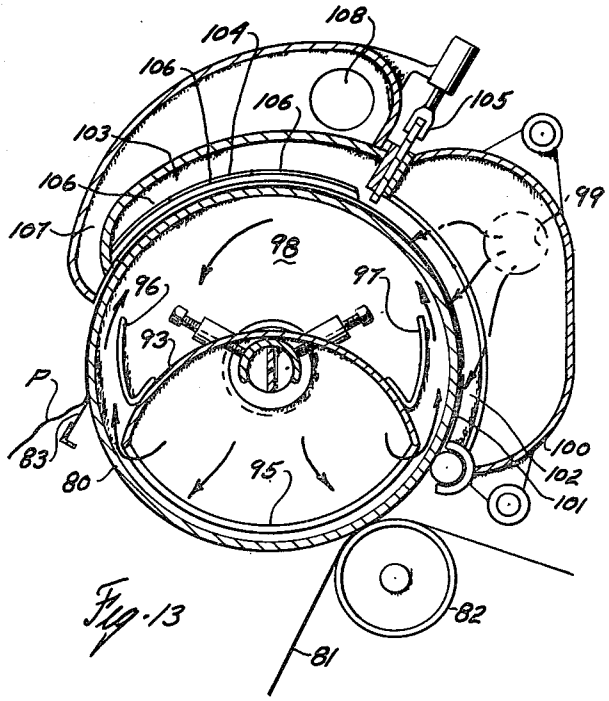
FIG. 13 is a cross sectional end view of the paper drum of FIG. 12, the section being taken approximately along line 13—13 of FIG. 12.
Figure 12:
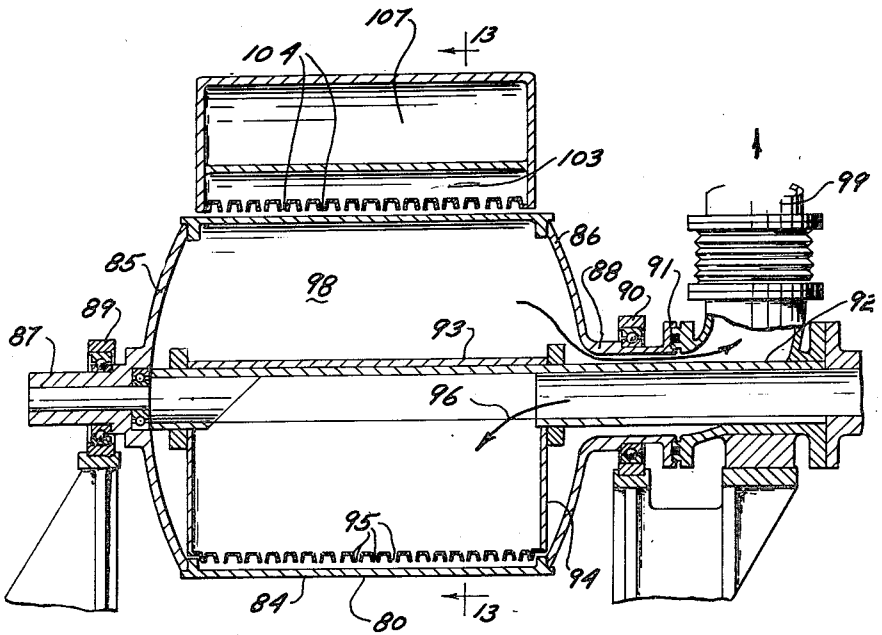
FIG. 12 is a somewhat simplified sectional elevational view of a paper drying drum constructed in accordance with the invention.

FIGS. 12 and 13 illustrate the application of various features of the present invention to a Yankee-or- MG-type dryer. The dryer has a relatively large diameter drum 80, which is rotated counter-clockwise as FIG. 13 is drawn. Wet paper is carried to the dryer on a web or felt 81 and is transferred to drum 80 by means of pressure roll 82. The paper, after drying, is stripped from the drum 80 by doctor blade 83. The strip of paper is designated in FIG. 13 by the letter P.

Heat for drying the paper is supplied to the Yankee-type drum by hot high pressure gases generated by the means and methods described above. Heat transfer is effected between these gases and the drum 80 and the paper P in three stages, according to the preferred embodiment. The heat transfer gas may be used serially in the three stages, or, two or more of the stages may be supplied with gas directly from the generating means. The three stages, in their preferred sequence, if the gas is passed through them serially, are first, heating by gas impingement on the internal surface of the Yankee drum; second, radiant heating of the paper from a point outside the drum; third, the direct impingement of heat transfer gases onto the paper being carried by the drum.

The Yankee drum 80 consists generally of a cylindrical surface 84 having two gas-tight end pieces 85 and 86 fitted to it. The end pieces include shaft members 87 and 88 journaled respectively in bearings 89 and 90. The construction just described results in a drum dryer mounted for rotation, which drum dryer is adapted to contain hot heat transfer gases in the interior thereof.

As mentioned above, one stage in which hot high pressure heat transfer gases are utilized involves the heating of the drum from the interior thereof. In order to accomplish this, shaft member 88 is hollow and is fitted at its outer end with a gas-tight rotary joint 91. A heat transfer gas input line 92 passes through joint 91 and shaft member 88 coaxial therewith, and substantially coaxial with the Yankee drum 80. This line feeds hot heat transfer gases to the interior of plenum 93. Plenum 93 is mounted in the interior of drum 80, but does not rotate therewith. It is roughly shaped like a segment of a circle, in end view, as shows most clearly in FIG. 13. The curved surface 94 of plenum 93 which is presented to the interior surface of drum 80 is made up of a series of slot-like nozzles 95 arranged in side-by-side relationship to one another across the width of drum 80. As can be seen in both FIGS. 12 and 13, the exit ends of nozzles 95 are spaced slightly from the interior surface of drum 80.

In accordance with the invention, nozzles 95 are pitched helically with respect to the interior of drum 80. This has several advantages. By this means, every increment of width of drum 80 is at some point directly exposed to hot high pressure gases issuing directly from nozzles 95, even though the nozzles are spaced a finite distance apart.

Hot high pressure gas is fed into plenum 93 through input line 92 as indicated by arrow 96. It passes through nozzles 95 and impinges against the interior surface of drum 80. Because of the rotation of drum 80 with respect to nozzles 95, and because of the slot-like configuration of the nozzles, and further because of the high pressure of the gases in the interior of the plenum 93, conditions are created at the interior surface of drum 80 which are extremely favorable for efficient heat transfer. That is to say, the three features just mentioned tend to result in a very thin gas film on the interior of drum 80, which film offers a relatively low resistance to heat flow. The turbulent condition of gases passing through nozzles 95 and the turbulent condition of the gases on the underside of the nozzles 95 tends to maximize the transport of heat to the interior surface of drum 80, as well as tending to reduce the film thickness of the film of relatively quiescent gases at the very surface of drum 80. In this manner, efficiency of heat transfer from the gases to the paper being dried is materially increased.

FIG. 14 illustrates, in an enlarged cross-sectional view, two of the nozzles 95 constructed in accordance with the invention. The distance (d) between the center lines of adjacent slot-like nozzles is preferably less than the helical pitch of each nozzle from one end to the other. This feature provides complete assurance that every increment of width of drum 80 is exposed directly to hot high pressure gas, as explained above. The highly turbulent flow of the gases after passage through the nozzles is shown by the arrows on FIG. 14.

Returning now to FIG. 13, it can be seen that converging nozzles 96 and 97 are provided at each end of the plenum 94 for directing hot gases which have passed through nozzles 95 in paths adjacent the interior surface of drum 80 as the gases flow into the upper portion 98 of the interior of the drum 80. Such nozzles extend the effective exposure time of the hot gases to the interior surface of drum 80.

The upper portion 98 may be thought of as a gathering chamber for the partially spent heat transfer gases which have passed through plenum 93, nozzles 95, and converging nozzles 96 and 97. The gases pass out of this chamber 98 through hollow shaft 88 and into duct 99. Duct 99, the end of which is shown in phantom outline in FIG. 13, conveys the hot high pressure gases into the next heat transfer stage. This stage consists of a plenum 100 having a concave radiator plate 101 forming one wall thereof. The curved radiator plate 101 is shaped and positioned to fit closely around a portion of the surface drum 80, but does not contact the drum. There is a narrow passage or space between the concave face of radiator plate 101 and the outer surface of drum 80 through which the paper (p) being dried passes.

Mounted within the second stage plenum 100, closely adjacent the convex inner surface of radiator plate 101, is an array of nozzles 102. Nozzles 102 are much like nozzles 95 in structure and arrangement, in that they are arranged side by side across the width of second stage plenum 100, and thus extend substantially across the width of the drum 80. In addition, they are helically pitched, and adjacent nozzles are spaced from one another a distance less than the helical pitch. Hot high pressure gases obtained from the first heat transfer stage as just described enter plenum 100 from duct 99. They pass through nozzles 102 and impinge against the inner surface of radiator plate 101. The heat thus transferred to radiator plate 101 is ultimately transferred radiantly to the paper passing by the plate on the surface of drum 80.

The foregoing structure results in the creation of conditions at the interior surface of radiator plate 101 which are very favorable for efficient transfer of heat from the gases to the radiator plate. That is to say, the hot high pressure gases passing through nozzles 102 impinge on plate 101 strongly and have high internal turbulence. Thus, the film of quiescent gases at the surface is very thin and presents a reduced barrier to heat transfer.

The partially spent gases which have passed through nozzles 102 and have given up heat to radiator plate 101 are exhausted directly into the third heat transfer stage. The structure of the third stage can be seen in both FIGS. 12 and 13. It includes a third stage plenum 103, which is positioned adjacent the outer surface of drum 80. One side of this plenum is made up of an array of impingement nozzles 104 and are curved to fit closely around part of the surface of drum 80, and to discharge thereon. These nozzles 104 are structurally very similar to the nozzles 102 of the second stage and the nozzles 95 of the first stage. Like the earlier set of nozzles, the nozzles 104 are arranged in side by side array across the width of plenum 104, and thus substantially across the width of drum 80, and are helically pitched, in addition to being spaced from one another a distance less than the helical pitch. The gases passing from the second stage into plenum 103 of the third stage are metered by an adjustable gate 105. It should also be noted that the nozzle array 104 is provided with a series of deflector plates 106 to give downward impetus to the gas.

The gases from the second stage pass through gate 105 into plenum 103 and then downwardly through nozzles 104 to impinge directly on the paper on the outside of drum 80. The high velocity impingement of the hot gases provides for good heat transfer from the gases into the paper and for good mass transfer of water out of the paper into the gas. The third stage is provided with an exhaust plenum 107, which is positioned near the surface of drum 80 adjacent the downstream end of nozzle array 104. This plenum is preferably operated at slightly below atmospheric pressure, and the low pressure gases are withdrawn through duct 108 for recycle or auxiliary use or disposal.

As mentioned above, the gases are impinged in the third stage directly onto the paper. FIG. 15 illustrates somewhat diagrammatically the mechanism by which this occurs. The paper is indicated by the letter (P) and the helically pitched lines 109 represent the nozzle outlets. The set of vectors designated (A) illustrate the fact that the initial velocity of the gas passing through the nozzles is greater than the velocity of the paper and the gas will therefore tend both to spread into the space between nozzles and to move down the paper. Eventually, the gas loses enough velocity so that it does not tend to move down the paper but rather tends to spread across the paper, this condition being indicated by the bracket (B). Still later, the paper will give an impetus to the gas and restore a downstream component to it by means of a drag effect. This condition is illustrated by the bracket (C). It should also be realized that a similar mechanism of gas flow occurs adjacent the interior surface of drum 80 when gas passes through nozzles 95.

It will be noted that the arrangement of equipment for the Yankee dryer just described makes use of two stages in which the hot high pressure gases are brought into indirect heat transfer relationship with the paper being dried, followed by one stage in which the gases are directly contacted with the paper. This arrangement is of great advantage when the initial temperature of the heat transfer gases is very high. When the initial temperature of the heat transfer gases is somewhat lower, it may be desirable to have two stages in which the gases are directly contacted with the paper to be dried.

This goal may be accomplished by a very simple modification of the equipment just described. The second stage, that is the stage which includes plenum 100, radiator plate 101, and nozzles 102, may be modified to omit radiator plate 101 so that nozzles 102 discharge directly onto the paper passing around drum 80. The gas, after it contacts the paper, passes into plenum 103 of the third stage.

In both of the arrangements just described, the hot gas is brought into direct contact with the paper being dried in at least one stage. When the gas is employed in this manner, it must be relatively clean, that is, free of soot and other particulate matter, because such entrained dirt will tend to be deposited on the paper being dried. Even if all of the stages utilizing the hot gas for heat transfer are like the first stage just described, and involve only indirect contact between the gas the paper, it may be desirable to have the gases in reasonably clean condition so that a deposit of dirt and soot is not accumulated on the heat transfer surface, such as the interior of drum 80. Soot and the like, when formed into a layer, has a relatively low coefficient of heat transfer, and hence, is not a particularly desirable material to have in the path of heat transfer.

From the above discussion it will be remembered that in accordance with the invention provision is made to take advantage of low cost, relatively dirty burning fuel in the generation of the hot high pressure heat transfer gases. In order to take full advantage of this feature of the invention, without encountering the disadvantage caused by soot just discussed, it may be desirable to interpose filter means between the point where the hot high pressure gases are created, and the point where they are utilized, and especially before the point where they are utilized in direct contact with the paper being dried.

Such filter means are illustrated in FIG. 16. This figure illustrates a cylindrical continuously operating and continuously cleaned filter which may be positioned at a point in the gas flow path, for example, within plenum 100. As can be seen in FIG. 16, the filter unit 110 consists of a cylindrical tube 111 having a foraminous surface, and a porous filter material 112 lining the interior thereof. The cylinder 111 is mounted for rotation in the interior of plenum 113, which may be, as remarked above, plenum 100 of FIG. 13, or another plenum in a different arrangement. In operation, hot, high pressure, and relatively dirty, gas is fed into the interior of a cylinder 111 as indicated by the arrow 114. The gas passing into the interior of cylinder 111 flows through the walls thereof and outwardly into the interior of plenum 113. The particulate matter in the gas is filtered by filter material 112.

Mounted within cylinder 111 is a small plenum 115, and mounted exteriorly of the cylinder 111, immediately opposite plenum 115 is still another plenum 116. Plenum 116 may be termed a purge input plenum, and plenum 115 may be termed a purge exhaust plenum. Purge fluid, such as air, is forced through plenum 116 as indicated by arrow 117. The purge fluid passes inwardly through the wall of cylinder 111 into the exhaust plenum 115. In doing so, it dislodges and entrains the soot on the filter material 112 positioned at the moment between plenums 116 and 115. Thus the purge gas picks up the dirt from the filter. The purge gas then passes out through exhaust plenum 113 as indicated by the arrow 118 carrying the dirt with it. One convenient source for the purge fluid is compressed air from the compressor of the hot high pressure gas generating means.

As was mentioned above cylinder 111 is mounted for rotation, and in operation is turned continuously, and in consequence part of the filter material 112 is constantly being cleaned by the purge means just described, while the remainder of filter material 112 is filtering incoming gas.

According to the preferred arrangement, a filter of the kind shown in FIG. 16 should be positioned to extend substantially across the full width of a plenum of a given stage. In this way large filter areas are obtained, and the natural resistance of the filter tends to equalize the pressure distribution across the plenum, and thus to equalize the distribution across the array of nozzles associated with the plenum.

In another embodiment, the sealing strips 119 between the rotary cylindrical tube 111 and the plenum 116 may be removed, thereby allowing the filtered gases to also purge in place of an independent supply 117. This would of course require that the pressure of the filtered gases is higher than the exhaust 118.

PAPER AND PAPER BOARD DRYERS

In contrast to the Yankee- and MG-type operations discussed in the preceding section, drying operations for heavier papers and boards are usually conducted by passing the web of paper to be dried over many cylinders in series. Conventionally, steam is condensed in the interior of such cylinders and hot air drying hoods are sometimes utilized adjacent the outer surface of the cylinders. The number of cylinders utilized on a line can be considerable; a newsprint production line may use as many as 100 or more cylinders, each about five feet in diameter.

Figure 17:
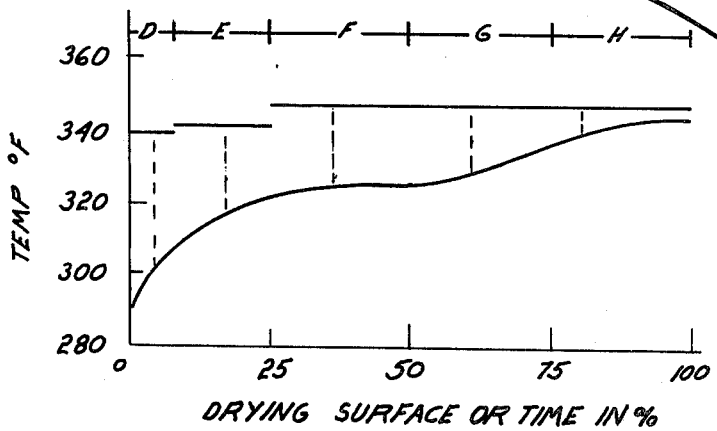
FIG. 17 is a graph of typical drying characteristics for paper.

In the drying of paper there is a distinct general pattern to the process, the particulars of which will vary for each operation, and each kind of paper, but the general outlines of which remain the same. This general pattern is illustrated in FIG. 17, which illustrates the drying process as a function of the difference between the saturated steam temperature within a conventional dryer, and the surface temperature of the dryer, as a function of time. The saturated steam temperature is shown in FIG. 17 as a series of horizontal lines for various stages, and the surface temperature is shown sloping upwardly to the right. The vertical distance between the horizontal line and the curve is an inverse measure of the resistance to drying exhibited by the paper. This resistance increases as the moisture content of the paper decreases. As can be seen from FIG. 17, a great proportion of the drying time is occupied in the high resistance region.

Figure 18:
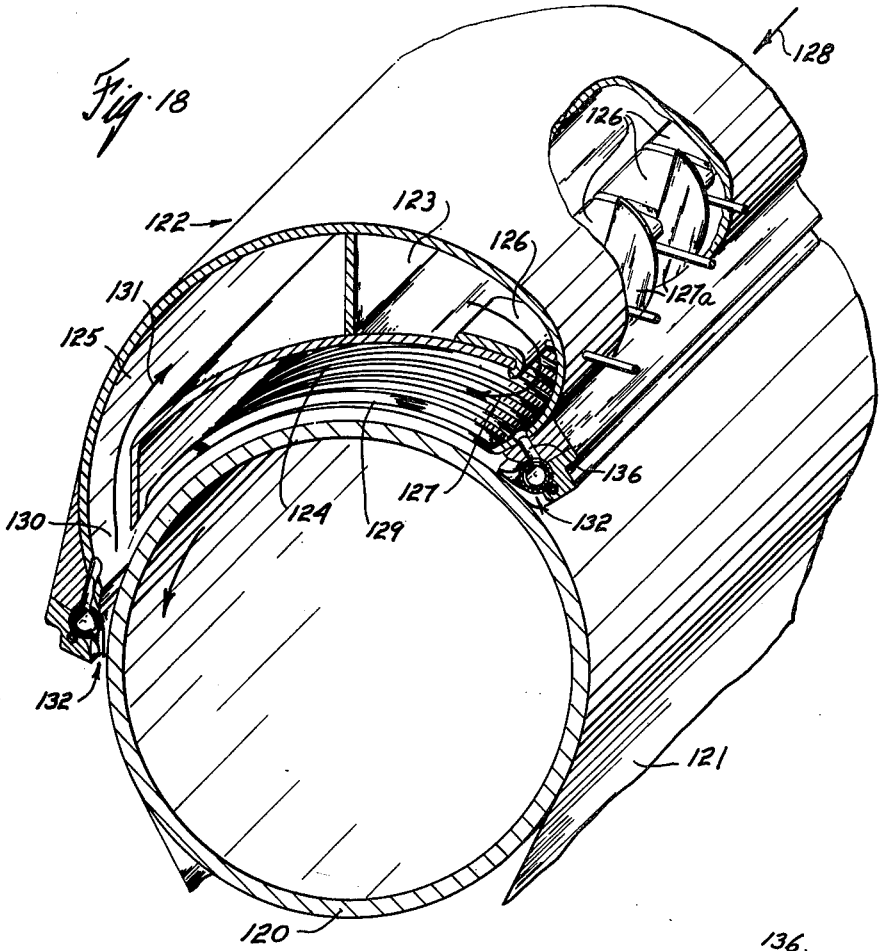
FIG. 18 is a perspective view, somewhat simplified, with parts broken away, of another embodiment of heat transfer equipment for utilizing hot high pressure gases.
Figure 19:
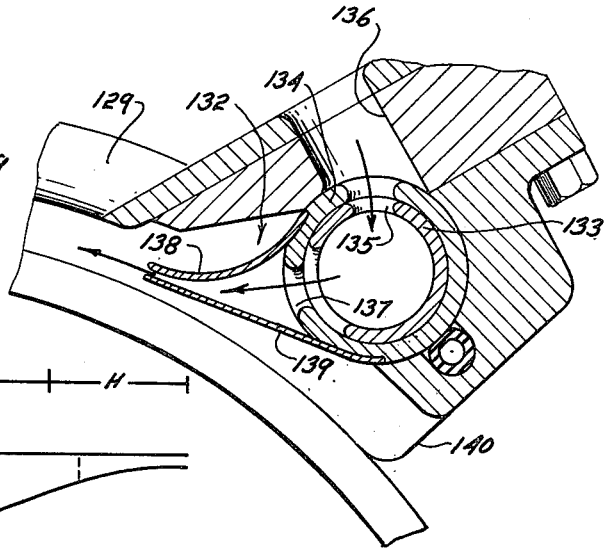
FIG. 19 is a cross sectional elevational view of a jet doctor blade utilized in the unit of FIG. 18.

As mentioned above, hot air hoods have been used to force air onto paper passing over the cylinders, to supplement the heating obtained from condensing steam inside the cylinders. The hot air typically exhausts laterally from the surface of the paper. This has the unfortunate effect of tending to make the paper float on the cylinder. FIGS. 18 and 19 illustrate an embodiment of the present invention especially adapted for use with conventional paper drying cylinders. In FIG. 18 such a cylinder is shown at 120, with a web or sheet of paper 121 being passed around it. The cylinder 120 may be conventionally equipped to receive saturated steam in the interior thereof, or may be equipped to utilize hot high pressure gas in the interior thereof in a manner similar to the Yankee dryer illustrated in FIGS. 12 and 13.

A drying unit 122 is provided for the cylinder 120. It has a supply plenum 123, a nozzle chamber 124 and an exhaust plenum 125. Gas passes from the supply plenum 123 into the nozzle chamber 124 by passing over a series of throttling gates 126 in the manner indicated by arrow 127. The flow rate may be adjusted by varying the positions of gates 126. If desired, sectional dividers **127*a* may be included between gates 126 so that different degrees of throttling can be achieved across the width of the plenum 123 by setting various gates 126 at different positions. Gas is fed into the plenum 123 laterally as indicated by arrow 128. It flows from plenum 123 into nozzle chamber 124. One wall of the nozzle chamber is made up of an array of nozzles 129 like those described in connection with the Yankee dryer of FIGS. 12 and 13. Nozzles 129 are helically pitched, and are spaced apart a distance smaller than the helical pitch. They extend substantially across the width of the drum 120**.

The gas passes through the nozzles and impinges upon the paper in a manner to effect good heat transfer into the paper and good mass transfer of water out of the paper. The highly turbulent condition of the gases contributes to these effects. At the end of the nozzle section the before-mentioned exhaust plenum has its intake opening 130. Gas passes from the paper surface into the exhaust plenum, and thence laterally outward as indicated by arrow 131. The gas taken out of exahaust plenum 130 may be used in another unit on another cylinder, may be disposed of, or may be recycled in part.

The ends of the plenums and nozzle chamber are sealed, and the sealing walls closely approach the cylinder 120 so that little gas escapes laterally from the surface. In order to minimize gas loss circumferentially of the cylinder, seals are used at each circumferential limit of drying unit 122. While in some cases, conventional roller sealing may be effectively employed, in other instances such seals would be undesirable because of their tendency to damage the paper. Hence, there is provided in accordance with the invention a rotatable jet doctor blade 132 which is illustrated in FIG. 19 on an enlarged scale. The jet doctor blade 132 includes a cylindrical manifold 133 having an adjustable sleeve 134 around it. Both the manifold and sleeve are ported in two locations, one port 135 being located opposite inlet passage 136, and the other port 137 being located opposite blades 138 and 139. High pressure gas enters the jet doctor blade through inlet passage 136 and passes outwardly through blades 138 and 139. This gas, being a somewhat higher pressure than the gas passing through nozzles 129, prevents the escape of the bulk of the gas passing through the nozzles. Gas for the jet doctor blade may be provided from the nozzle chamber 124 or may be especially provided. An auxiliary, light, conventional doctor blade is provided at 140.

PRESS DRYING

In accordance with the invention the hot high pressure gases generated in the manner described above are also desirably employed for extracting water from extremely wet paper webs, consisting of approximately 80% moisture by weight, which paper webs may thereafter be subjected to the drying operations and methods disclosed hereinbefore.

According to prior practice, extremely wet paper webs have been mounted between endless felts which are then pressed between pairs of rollers. This practice has several disadvantages, among them being that the felts are compressed almost closed and are hence not able to receive water forced from the paper efficiently.

Figures 20, 21, 22, 23, 24, 25, 26:
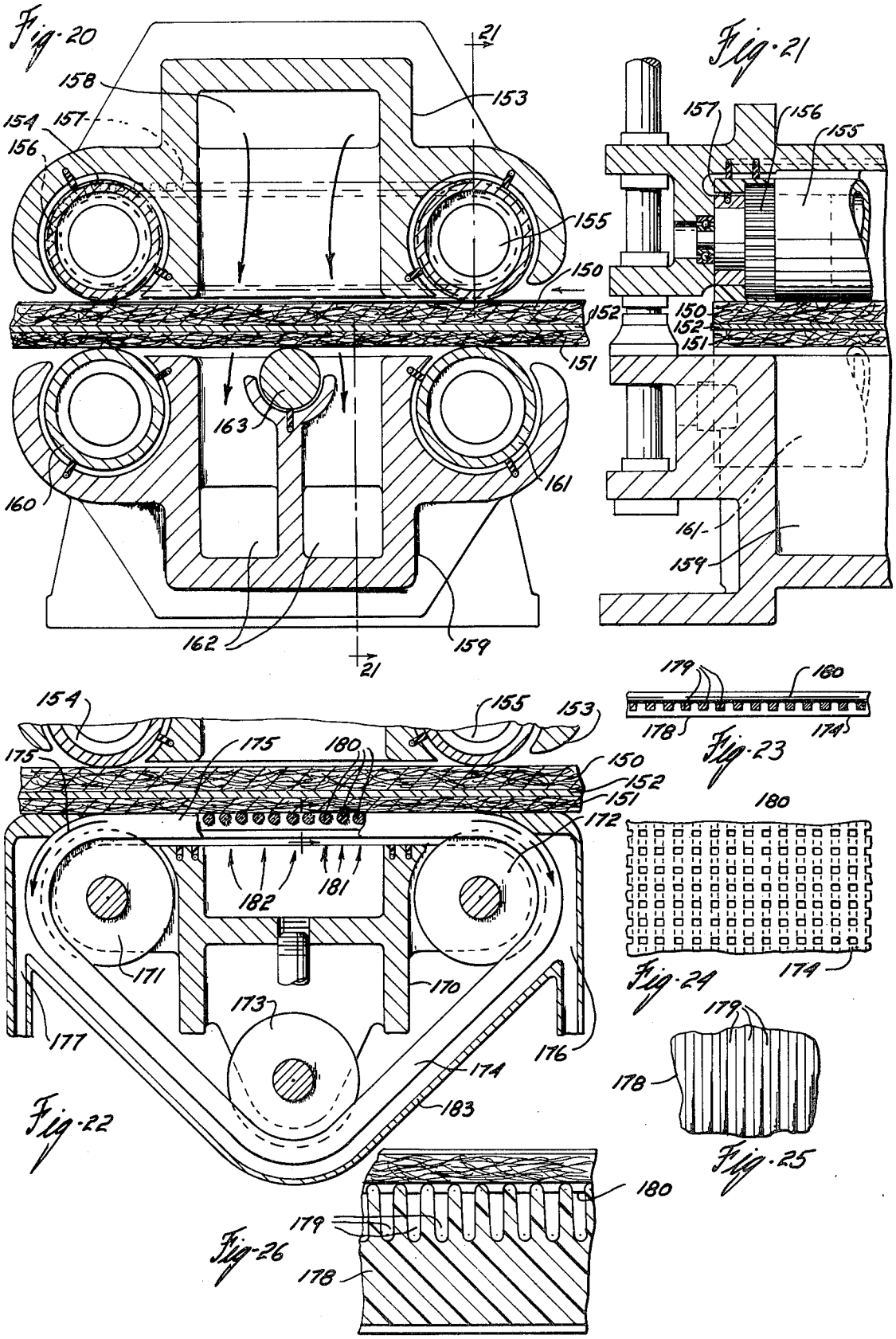
FIG. 20 is a cross sectional elevational view of apparatus constructed in accordance with the invention for directing hot high pressure gas through paper to effect water removal therefrom.
FIG. 21 is a cross sectional end elevation of the apparatus of FIG. 20, the section being taken approximately on the line 21—21 of FIG. 20.
FIG. 22 shows in cross sectional elevational view of an alternate embodiment of equipment suitable for drying paper by forcing hot high pressure gas therethrough.
FIG. 23 is an end cross sectional view of a special belt for use in the apparatus of FIG. 22.
FIG. 24 is a plan view of the belt of FIG. 23.
FIG. 25 is a plan view of the belt of FIG. 23 with one layer thereof removed.
FIG. 26 is a cross sectional elevational view of an alternate embodiment of the belt of FIG. 23.

In FIGS. 20 and 21 there is shown one form of an apparatus constructed in accordance with the invention which is designed to utilize hot high pressure gas for removing water from extremely wet paper. The unit consists of a pair of felts 150 and 151 between which is carried the paper 152. Above web 150 is an input plenum 153. It is equipped with a pair of rolls 154 and 155 which extend generally across the width of web 150. At their extremities, rolls 154 and 155 are equipped with teeth 156 over which are trained endless belts 157, so that the outer belt radius is the same as the roll radius. Adjacent these belts 157 are mounted side plates with pressurized seals on the outer belt and roll peripheries closing the sides of the plenum chamber. The inner belt periphery outboard of the teeth is also smooth to seal against the inner side plate in similar manner. The belts and side plates thus cooperate to prevent loss of gas laterally from the plenum chamber 153. Gas is fed into the plenum chamber through inlet 158.

Mounted below input plenum 153 is output plenum 159. It is provided with end rolls 160 and 161 for sealing purposes. Rolls 154, 160, and 155, 161 respectively are opposed to each other, so that some pressing action is exerted on the felt-paper sandwich as it passes through the nip between them. Gas leaves the output plenum 159 through passages 162. In order to provide additional support for the felt and paper sandwich, support roller 163 is mounted within the output plenum. In operation gas is fed into input plenum 153 at high pressure. The gas is hot, and thus tends to evaporate the water in the paper as it passes through it, as well as physically entraining it. The gas passes downwardly through the felt and paper sandwich into lower plenum 159 and ultimately out through passages 162. As the high pressure gas moves through the paper it both entrains water and evaporates water from the paper. It will also entrain and tend to evaporate the water which has been driven from the paper into the lower felt.

An alternate embodiment which is also quite suitable for providing for hot high pressure gas flow through a felt and paper sandwich is shown in FIGS. 22 through 27. In these figures, the upper or input plenum 153 is substantially the same as that used in the unit of FIG. 20. However, the lower unit is considerably modified. As can best be seen in FIG. 22, there is no output plenum in the conventionally used sense of the word. Instead a frame 170 is provided equipped with rollers 171 and 172 extending across the width of the web and paper sandwich—150—151—152. Rollers 171 and 172 are desirably placed opposite rollers 154 and 155 to obtain pressing action in the nip between the rollers. An additional bottom roller 173 is also mounted on the frame. Trained over rollers 171, 172, and 173 is an endless flat belt 174. Belt 174 is impervious in that gas and water will not pass through it, but it is specially configured to permit gas to flow into the interior of the belt, and thence along the belt. This mode of flow is indicated by the arrows 175 in FIG. 22. Gas gathering plenums 176 and 177 are provided adjacent rollers 171 and 172 respectfully for collecting gas flowing out of the belt 174 as it bends around these rollers. Plenums 176 and 177 are connected by a shroud 183 for seal purposes. The side walls (not shown) are sealed to the belt in a manner similar to the outer periphery of the belt in FIG. 21.

The structure of the belt 174 may be understood by a consideration of FIGS. 23, 24, and 25. From these figures it can be seen that the belt 174 is made up of a bottom strip or sheet 178 having a number of grooves 179 formed in it. The grooves run lengthwise of the belt. Above the grooves, running traverse of the belt, are a number of strips or rods 180. Thus, when the belt 174 is seen in plan view, as in FIG. 24 it has a grid-like appearance, notwithstanding tht it is impervious in the sense described above. FIG. 25 shows in plan view the bottom layer of the belt 178 with grooves 179, the rods 180 having been removed. FIG. 26 shows a similar structure having deeper grooves 179 in the bottom piece 178, and having notched rods 180.

Between rollers 171 and 172 of lower frame 170 there is provided a pressure plenum 181. Gas is fed into this plenum to apply a supporting force as indicated by arrows 182 on the underside of belt 174 in the region between rollers 171 and 172.

FIG. 27 illustrates the operating features of the embodiment of FIG. 22. Hot high pressure gas is fed into input plenum 153 through inlet duct 158. It passes through the felt and paper sandwich 150, 151, 152, and into the interior of belt 174. It flows through the belt to either collectors 176 or 177. Belt 174 is supported by gas under pressure from pressure plenum 181.

The left half of FIG. 27 illustrates the operating features of the embodiment of FIG. 20. That is, where the flow of gases through the sandwich are not diverted, but are caused to pass directly into plenum 159 and out exhaust 162.

In FIG. 29 there is shown a unit employing a plurality of input and output plenums of the kind shown in FIG. 20, the plenums being located between a single set of rollers 184, 185, 186, and 187. Such an arrangement results in economy in equipment and space. Furthermore, in accordance with the invention, alternate pairs of plenums have gas passed through them in opposite directions. Thus plenum pair 188–189 is a down-flow pair while plenum pair 190, 191 is an up-flow pair. This imparts a pulsating action to the water in the paper and the felts and increases efficiency of water removal. In addition, any compacting action on the felt by reason of the high pressure gas pressing against it in any one pair of plenums is remedied by the opposite flow of gas in the next succeeding pair of plenums.

At various points in the equipment of FIGS. 20, 22 and 29, as well as in the equipment to be described in FIG. 30, pressure loaded seals are desirable. Such a seal is shown in FIG. 28 where it can be seen that two generally parallel slides 200 and 201 are provided for sliding sealing contact with a web 150. Between the parallel slides 200 and 201 is an exhaust line 203 to which suction may be applied to prevent leaks to the atmosphere.

FIG. 30 illustrates another form of the invention adapted to remove water from very wet paper webs in accordance with the invention. In this embodiment, there is provided a drum 210 having a surface configured much like that of the belt 174 described in connection with FIGS. 22 to 24. Thus, the surface of cylinder 210 is impervious, but is arranged to permit gas flow in the interior thereof. Such a grid-like surface is indicated at 211. Alternately, the surface may merely be grooved, as at 212, to provide for gas flow along the surface. A felt 213, carrying a web of paper 214 is passed over the cylinder 210 in a clockwise direction as FIG. 30 is drawn. An additional felt 215 is fed over the paper web 214 by roller 216 to form a felt-paper sandwich. A gas input plenum 217 is positioned around that portion of cylinder 210 transversed by the felt-paper sandwich. The plenum is divided into a number of compartments 218, 219, 220, 221, and 222, circumferentially around the cylinder so that hot high pressure gas at varying pressures may be fed through the paper being moved around cylinder 210. The gas passes from a given compartment of the plenum downwardly through the felt and paper sandwich and into the grooves provided on the surface of the drum. It then passes around the drum to the collector plenum 222*a*, or to a similar plenum (not shown) on the opposite side of the drum connected by shroud 225. Pressure loaded seals of the kind described in connection with FIG. 28 are provided at 223 and at 224 on either side of the plenum 217.

An alternate to the embodiment of FIG. 30 is the case where the drum is pervious to the flow of gases and vapors such as the suction roll well known to those familiar in the art of paper making.

In all the embodiments of press drying the use of the top felt is optional when the flow of gases is directed from the top down through the paper, but then the paper must be narrower than the bottom felt or carrier, and the side plates in sliding seal with the end rolls, must be similarly sealed to the bottom felt or carrier.

By way of summary, it can be pointed out that the equipment described herein results in the provision of means and methods for generating hot high pressure gases for heat transfer purposes and methods and equipment which exploit the excellent properties of such gases as heat transfer fluids to the fullest possible extent in a wide range of drying applications, varying from very wet fragile paper webs, through tissue-type paper, to heavy Kraft paper and paper board.

I claim:

1. Apparatus for generating hot high-pressure combustion gases and for directing them onto material being processed while moving in a continuous path, comprising an expanding-fluid drive means with a high-pressure inlet port, at least one compressor means driven thereby and having a high-pressure discharge port, combustion means designed for temperatures above 1500° F. and interconnected by ducting to the high-pressure discharge port of said compressor means and the high-pressure inlet port of said expanding-fluid drive means, cooling-fluid injection means operatively associated with the ducting between said combustion means and said expanding-fluid drive means, an independent discharge duct from said combustion means for delivering high-pressure gases containing most of the available energy as kinetic and flow energy and at temperatures substantially in excess of the high temperature limit of said expanding-fluid drive means, and means connected with said independent discharge duct for conducting said high-pressure gases onto said material.

2. Apparatus according to claim 1 wherein a jet pump is connected to said independent discharge duct.

3. Apparatus for generating hot high-pressure combustion gases, and for directing them onto material being processed while moving in a continuous path, comprising an expanding-fluid drive means with a high-pressure inlet port, at least one compressor means driven thereby and having a high-pressure discharge port, an engine-cycle combustion means designed for combustion temperatures in excess of 900° F. and interconnected by ducting to the high-pressure discharge port of said compressor means and the high-pressure inlet port of said expanding-fluid drive means, a second combustion means, designed for temperatures substantially in excess of 1500° F., which is separately fueled, a diverting duct leading from said discharge port and connected to said second combustion means, said diverting duct having control means and being adapted to divert a portion of the gases delivered by said compressor means to said second combustion means, said diverting duct being constructed to accommodate said portion as containing most of the available energy as kinetic and flow energy developed in said engine-cycle combustion means, and means connected to at least one discharge port of said second combustion means for conducting said high-pressure gases onto said material.

4. Apparatus according to claim 3 wherein at least one jet pump is connected to a discharge port of said second combustion means.

5. Apparatus according to claim 4 wherein there is a cooling-fluid injection means in the ducting between said engine-cycle combustion means and said expanding-fluid drive means.

6. Apparatus according to claim 4 wherein there is a cooling-fluid injection means between said discharge port from said second combustion means and said jet pump.

7. Apparatus, according to claim 1, adapted for drying paper and including means establishing a travel path for a web of paper to be dried, means for moving said web of paper through said travel path, means establishing a path of flow for hot, high-pressure gases, said path of flow including a plurality of stages wherein said gases are brought into heat exchange relationship with paper moving in the travel path of the paper, each said stage comprising a gas supply plenum, an array of nozzles extending across a side of said plenum adjacent the travel path to provide for escape of gases from the plenum, said nozzles being oriented with their discharge ends toward the travel path, and collecting means positioned to collect and convey away from said travel path the gases passing through said nozzles.

8. Apparatus, according to claim 3, adapted for drying paper and including means establishing a travel path for a web of paper to be dried, means for moving said web of paper through said travel path, means establishing a path of flow for hot, high-pressure gases, said path of flow including a plurality of stages wherein said gases are brought into heat exchange relationship with paper moving in the travel path of the paper, each said stage comprising a gas supply plenum, an array of nozzles extending across a side of said plenum adjacent the travel path to provide for escape of gases from the plenum, said nozzles being oriented with their discharge ends toward the travel path, and collecting means positioned to collect and convey away from said travel path the gases passing through said nozzles.

9. Apparatus according to claim 1, adapted for drying paper, and including means establishing a travel path for a web of paper to be dried, foraminous means for moving said web of paper through said travel path, and supporting it at least on one side, means establishing a path of flow for hot, high-pressure gases, said path of flow including at least one station wherein said gases are brought into heat transfer relationship with said paper, each said station comprising a gas supply and mating gas collecting plenums located opposite each other for constraining the path of said hot gas flow through said foraminous means and said paper, sealing means between said plenums and said foraminous means for confining said high-pressure gases, means cooperating with said sealing means and said plenums to withstand the pressure separating forces between plenums and the pressure drop of said hot gases through said foraminous means and said paper, and gas conducting means from said collecting plenums positioned to convey away water vapor and water droplets entrained with said gases from said drying of said paper.

10. Apparatus according to claim 3, adapted for drying paper, and including means establishing a travel path for a web of paper to be dried, foraminous means for moving said web of paper through said travel path, and supporting it at least on one side, means establishing a path of flow for hot, high-pressure gases, said path of flow including at least one station wherein said gases are brought into heat transfer relationship with said paper, each said station comprising a gas supply and mating gas collecting plenums located opposite each other for constraining the path of said hot gas flow through said foraminous means and said paper, sealing means between said plenums and said foraminous means for confining said high-pressure gases, means cooperating with said sealing means and said plenums to withstand the pressure separating forces between plenums and the pressure drop of said hot gases through said foraminous means and said paper, and gas conducting means from said collecting plenums positioned to convey away water vapor and water droplets entrained with said gases from said drying of said paper.

11. Apparatus according to claim 7, wherein at least one of said stages comprises a sealed pressure plenum, for indirect heat transfer to said paper, connected to receive at least a portion of said gases with at least one outlet for delivering said portion, after said indirect heat transfer, to another of said stages.

12. Apparatus according to claim 7, adapted for drying paper, including means establishing a travel path for a web of paper to be dried, foraminous means for moving said web of paper, and supporting it on one side, through said travel path, means establishing a path of flow of hot, high velocity gases onto the exposed side of said web of paper, stationary vacuum means sealed to the underside of said foraminous means for drawing at least a portion of said hot gases through said web of paper and said foraminous means, and collecting means for removing the remaining portion of said gases not drawn through the web of paper.

13. Apparatus for drying, comprising a hollow drying cylinder adapted to carry material to be dried on the outer surface thereof, means mounting said drying cylinder for rotation, a gas plenum mounted inside said drying cylinder, said plenum being adapted to remain in fixed angular position during rotation of said drying cylinder, an array of nozzles mounted on said plenum, said array being constructed so that the discharge ends of said nozzles establish a substantially cylindrical surface substantially coaxial with the inside surface of said drying cylinder and closely adjacent thereto, the input-ends of said nozzles communicating with the interior of said plenum, gas input means extending from a point exterior of said cylinder to the plenum, said input means being adapted to deliver hot gases to said plenum while the cylinder is rotating, gas exhaust means extending from a point exterior of said cylinder to the interior of said cylinder but exterior of the plenum, said exhaust means being adapted to deliver hot gases out of said cylinder, while it is rotating, to a fixed conduit connected to at least one externally mounted gas plenum which is equipped with discharge nozzles the extremities of which form an array that is fixed in space and equidistant from, but in close proximity to, the external circumferential surface of said drying cylinder, said externally mounted plenum being thereby adapted, with the nozzles, to deliver said gases to flow onto said material and a compression-combustion-expansion means for generating hot high pressure gases and delivering said gases to said gas input means.

14. Apparatus for generating high pressure combustion gases to be directed onto material being processed and ordered to move in a continuous path, comprising expanding-fluid-drive means, at least one compressor means actuated thereby, at least one combustion means firing in excess of 900° F. connected to the discharge side of said compressor means, at least one said combustion means coupled to and sequentially powering ejector pumping means, said ejector pumping means incorporating at least one secondary inlet port and designed to receive combustion products containing most of the available energy developed by said expanding-fluid-drive means into its primary port as kinetic and flow energy for powering said ejector pumping means.

15. Apparatus according to claim 14, wherein said expanding-fluid-drive means, one said compressor means, and one said combustion means, comprise a compression-combustion-expansion engine.

16. Apparatus according to claim 15 wherein the combustion means coupled to said ejector pumping means and designed to transmit said available energy comprises a second combustion chamber connected to at least one said compressor means.

17. Apparatus according to claim 14, provided with an independently powered fluid injection means for augmenting the flow and lowering the temperature of the combustion products containing said available energy, said injector at the most powered to sustain the prior pressure of said combustion products flow at the point just in advance of the fluid injection means.

18. Apparatus according to claim 16, provided with an independently powered fluid injection means for augmenting the flow and lowering the temperature of the combustion products containing said available energy, said injector at the most powered to sustain the prior pressure of said combustion products flow at the point just in advance of the fluid injection means.

19. The apparatus of claim 1, having also a rotating cylindrical filter, and including means whereby said combustion gases are constrained to flow axially into and radially through the rotating cylindrical filter before being directed onto said material; said filter comprising a rigid shell substantially open to radial flow and covered with a permeable substance, and provided with a plenum and on the receiving end with a rotary joint which seals off the adjacent plenum and which envelops said filter to receive the filtered gases, and further provided with means for directing said gases onto said material; said filter being provided internally with a non-rotating long and relatively narrow receptacle, said receptacle being constructed with a long narrow opening, the edges of which are sealed in sliding relationship to said rotating cylindrical filter; said receptacle being provided at its far extremity with an exhaust duct that is concentric with and sealed in rotary relationship with the far end of said cylinder; said exhaust duct continuing through the wall of said plenum to a zone of lower pressure in order to induce a reverse purge through said permeable substance whereby to cause any filtered particles to be discharged into and through said receptacle to the outside of said plenum.

20. The apparatus of claim 3, having also a rotating cylindrical filter, and including means whereby said combustion gases are constrained to flow axially into and radially through the rotating cylindrical filter before being directed onto said material; said filter comprising a rigid shell substantially open to radial flow and covered with a permeable substance, and provided with a plenum and on the receiving end with a rotating joint which seals off the adjacent plenum and which envelops said filter to receive the filtered gases, and further provided with means for directing said gases onto said material, said filter being provided internally with a non-rotating, long and relatively narrow receptacle, said receptacle being constructed with a long narrow opening, the edges of which are sealed in sliding relationship to said rotating cylindrical filter; said receptacle being provided at its far extremity with an exhaust duct that is concentric with and sealed in rotary relationship with the far end of said cylinder; said exhaust duct continuing through the wall of said plenum to a zone of lower pressure in order to induce a reverse purge through said permeable substance whereby to cause any filtered particles to be discharged into and through said receptacle to the outside of said plenum.

21. The apparatus of claim 19, provided further with a non-rotating longitudinally-extending fluid-conducting means mounted adjacent to said filter and aligned radially and longitudinally with said long and relatively narrow receptacle; said conducting means being adapted to discharge fluid against and through said filter to boost said reverse purging through said permeable substance.

22. The apparatus of claim 20, provided further with a non-rotating longitudinally-extending fluid-conducting means mounted adjacent to said filter and aligned radially and longitudinally with said long and relatively narrow receptacle; said conducting means being adapted to discharge fluid against and through said filter to boost said reverse purging through said permeable substance.

23. Apparatus for generating high-pressure combustion gases and for directing them for heat transfer to a material being processed while moving in a continuous path, comprising a high-pressure combustion means designed to fire at temperatures in a range between 900° F. and 1500° F. or higher, having a combustion products outlet, and expanding-fluid drive means designed for inlet temperatures less than said firing temperature, an oxydant compressor mechanically attached to and powered by said drive means and connected to a delivery means for directing at least a portion of the oxydant to said combustion means, said delivery means adapted to deliver most of the available kinetic and flow energy developed by said expanding - fluid drive means, a fluid supply means connected to and adapted to supply power fluid to said drive means at said inlet temperatures, and conducting means connected to said outlet of said combustion means and adapted for controlling and directing the combustion products for such heat transfer to said material within the specified range.

24. Apparatus according to claim 13 wherein said hollow drying cylinder is constructed to operate at internal pressures above atmospheric.

25. Apparatus according to claim 13 wherein said hollow drying cylinder is constructed to operate at internal pressures substantially below that of a steam heated cylinder producing the same heat flow per square foot.

* * * * *